United States Patent [19]

Stockebrand et al.

[11] Patent Number: 4,851,834

[45] Date of Patent: Jul. 25, 1989

[54] MULTIPORT MEMORY AND SOURCE ARRANGEMENT FOR PIXEL INFORMATION

[75] Inventors: Thomas C. Stockebrand; Joel D. Kaufman; Earle R. Vicery, III, all of Albuquerque, N. Mex.

[73] Assignee: Digital Equipment Corp., Maynard, Mass.

[21] Appl. No.: 68,728

[22] Filed: Jun. 29, 1987

Related U.S. Application Data

[63] Continuation of Ser. No. 571,991, Jan. 19, 1984, abandoned.

[51] Int. Cl.[4] ..... G09G 1/02

[52] U.S. Cl. ..... 340/801; 340/798; 340/799

[58] Field of Search ..... 340/747, 750, 789, 799, 340/800, 801, 798

[56] References Cited

U.S. PATENT DOCUMENTS

| | | | |
|---|---|---|---|
| 4,149,151 | 4/1979 | Nagne et al. | 340/801 |
| 4,174,536 | 11/1979 | Misunas et al. | 364/900 |
| 4,203,107 | 5/1980 | Lovercheck | 340/744 |
| 4,425,643 | 1/1984 | Capman et al. | 340/801 |
| 4,447,809 | 5/1984 | Kodama et al. | 340/801 |
| 4,492,956 | 1/1985 | Collmeyer et al. | 340/747 |
| 4,504,828 | 3/1985 | Couper et al. | 340/750 |
| 4,546,451 | 10/1985 | Bruce | 364/200 |
| 4,625,203 | 11/1986 | DiNitto et al. | 340/750 |

FOREIGN PATENT DOCUMENTS 0147500 7/1985 European Pat. Off. .

*Primary Examiner*—David K. Moore
*Assistant Examiner*—Jeffery A. Brier
*Attorney, Agent, or Firm*—Michael N. Meller

[57] ABSTRACT

The present system includes, in a preferred embodiment, a plurality of bit map memory units which together define a large bit map memory. For each bit map memory unit there is also included a mask means and four extended shift registers. The shift registers can be loaded in parallel with pixel information through bidirectional data transmission channels which include bidirectional mask means. The pixel information can be routed through said bidirectional mask means to different address locations, or to the same address location, with certain of the pixel bits removed by the mask means. The shift registers have both serial and parallel input and output means and are clocked at different speeds to accommodate different peripherals. At least a first shift register is designed to be serially read out at a relatively high rate which can be advantageously used by a video display device or the like. Information signals from the other shift registers are transferred at high speed (in parallel) into and out of the large bit map memory to said first shift register whereby pixel information signals are settled down before being routed from said first shift register. The bidirectional mask means and the bidirectional data transmission channels along with the multiplicity of shift registers permit the present system to handle many varied operations which operate at different speeds, etc.

9 Claims, 11 Drawing Sheets

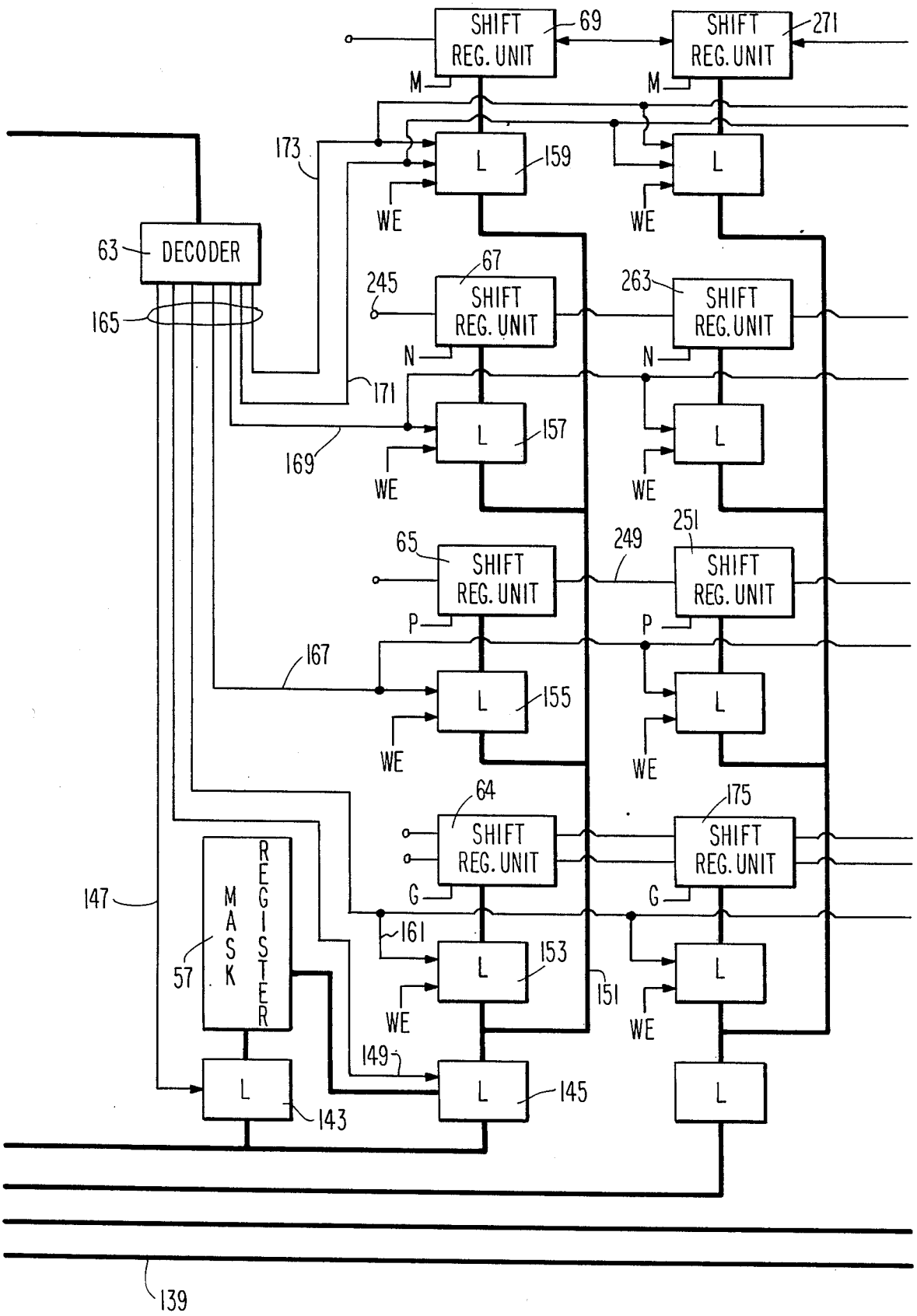
Fig. 3B1

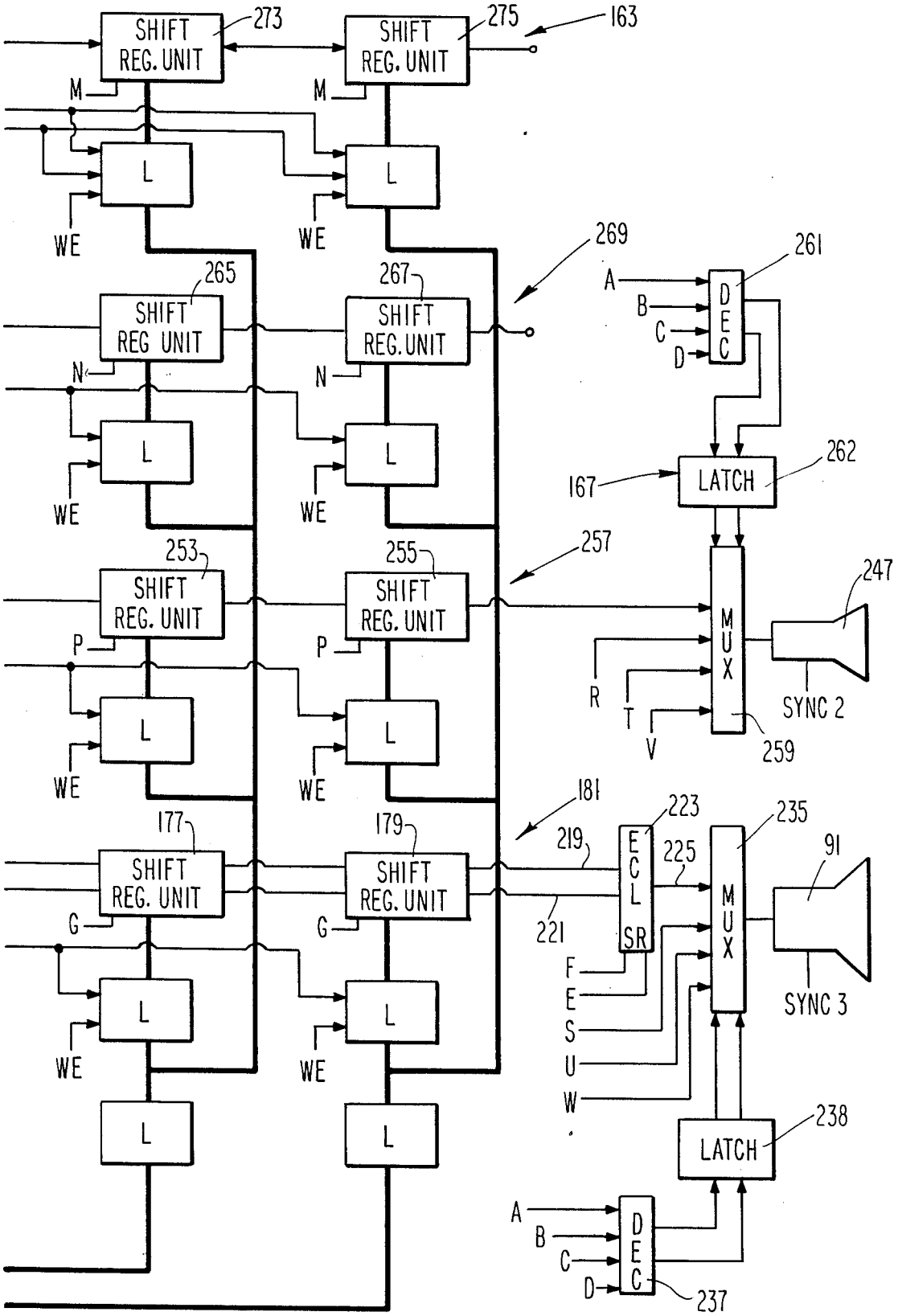
Fig. 3B2

MULTIPORT MEMORY AND SOURCE ARRANGEMENT FOR PIXEL INFORMATION

This application is a contiuation of application Ser. No. 571,991, filed 1/19/84, now abandoned.

BACKGROUND OF THE INFORMATION

The present invention is described by its use with a video display device but it should be understood that other output devices, such as a printer which handles serial information can employ the present invention.

It is generally the practice in the video display art (in order to display information on a video screen), to store information in a memory device and read said information therefrom into a shift register. The shift register is stepped in synchronism with the scan rate of an electron beam in the CRT. If the pixel information indicates that a dot should be present on the CRT, the beam will be turned on and if the pixel information indicates that a dot should not be present then the beam will be turned off. In the prior art, video display manufacturers have commenced employing bit map memory devices and in particular bit map memory units formed on integrated circuit chips. The bit map memories have the advantage that for each pixel location on the face of the display means, there is a pixel location in memory. Hence, the pixel information in the bit map memory can be read out to paint the picture, or to paint an alpha-numeric display, on the screen, without necessitating a great number of manipulations of information and accordingly very rapidly. However the state of the art has advanced such that pixel information is available (and desirable) from a number of pixel information input means. A major problem is that the pixel information sources operate at different speeds and very often the information signals are burdened with phase distortion, jitter, timing irregularities and the like. If such information is used directly from the source to the video display, the picture provided to the viewer is often unsatisfactory. In addition, with the introduction of high resolution display devices, (including means that provide varying character intensities and color presentations), the operational speeds of the shift registers and memories have represented limitations. Further as the video display systems have become more sophisticated, the demand has increased for: high resolution devices; full screen scrolling operations; window scrolling operations; the use of multiple video information sources, and the like. Heretofore there has not been a compact, flexible arrangement to accomodate the foregoing demands, particularly with the capability of being disposed on an integrated circuit chip. The present system provides a multiport memory means as well as a flexible signal routing means which enables the operations, enumerated above, to be effected as well as other operations and is compact enough to be disposed on an integrated circuit chip.

SUMMARY OF THE INVENTION

The present arrangement provides a large bit map memory to accomodate a high resolution display means. In a preferred embodiment, the large bit map memory is made up of a plurality of bit map memory units, i.e. bit map memory units, each disposed on a respective one of a plurality of integrated circuit chips. For each bit map memory chip (in a preferred embodiment) there is included a bidirectional mask means and four shift register units, each of which is designated to handle pixel information for different purposes. Each of the shift register units has several information input means and output means. The shift register units associated with each bit map memory unit and which are assigned to the same purpose are coupled to one another to form extended shift register means, to accomodate the large bit map memory. Connecting the extended shift register means to the large bit map memory is a plurality of bidirectional data transmission channels including bidirectional mask means. Accordingly pixel information can be loaded in parallel form from the bit map memory over said bidirectional channels, and alternatively can be read from the shift register means in parallel form to be transferred back into said bit map memory. Be that as it may, the extended shift register means can be stepped to be read out serially to a peripheral device, or can be stepped to merely change the position of the pixel information held therein. Accordingly the pixel information read from the extended shift register means can be returned in a different form arrangement to the large bit map memory. In addition such pixel information can be masked enroute and thus only certain pixel bits are loaded into the bit map memory. Alternatively only certain pixel bits are read from the bit map memory to effect such operations as window scrolling or a split screen presentation. The present system further includes an arrangement whereby the shift registers are clocked at different speeds to accomodate different input sources, such as different speed peripherals. Through this arrangement, pixel information signals from a peripheral source which are infirmed with phase distortion, jitter, timing irregularities and the like can be loaded into a suitable one of said shift registers. Thereafter the information, in better form, can be transferred through said large bit map memory into a particular shift register which is used to provide signals to a video display device. In a preferred embodiment said particular shift register is designed to be read out at a rate which is very much higher than the shift register units that make it up. This last mentioned extended shift register operates to be read out at very much higher rates than the remainder of the extended shift register means. The foregoing high speed readout enables such a high speed extended shift register to refresh and/or paint pictures on a high resolution display device. At the same time the information read into the high speed extended shift register can be read into a slower speed extended shift register and used to provide information to a slower speed peripheral. The bidirectional mask means enables the system to effect a split screen presentation, or window scrolling, and the like.

The features and objects of the present invention will be better understood in view of the following description taken in conjuntion with the drawings wherein.

Figure 4A:
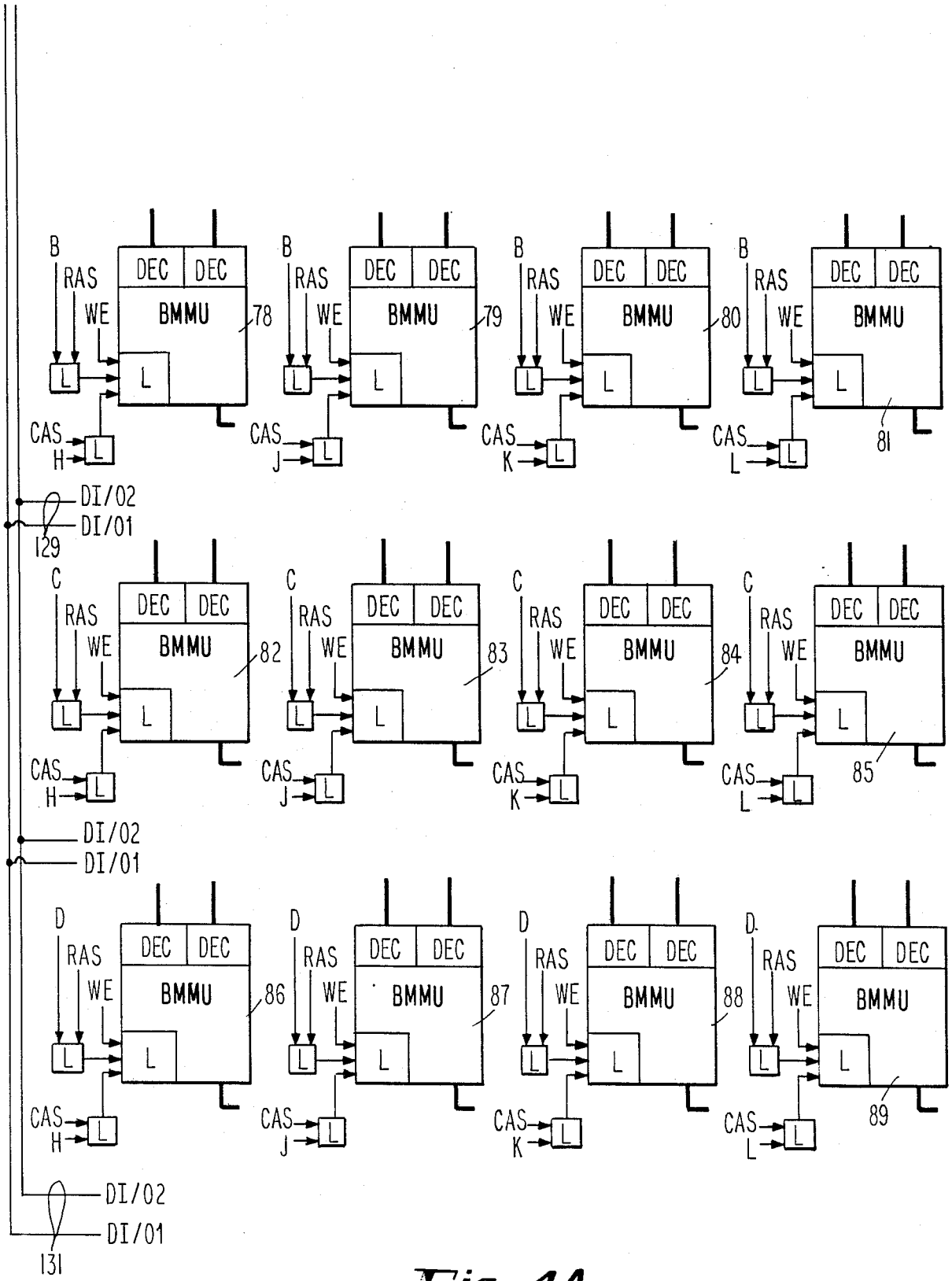
Figure 4B:
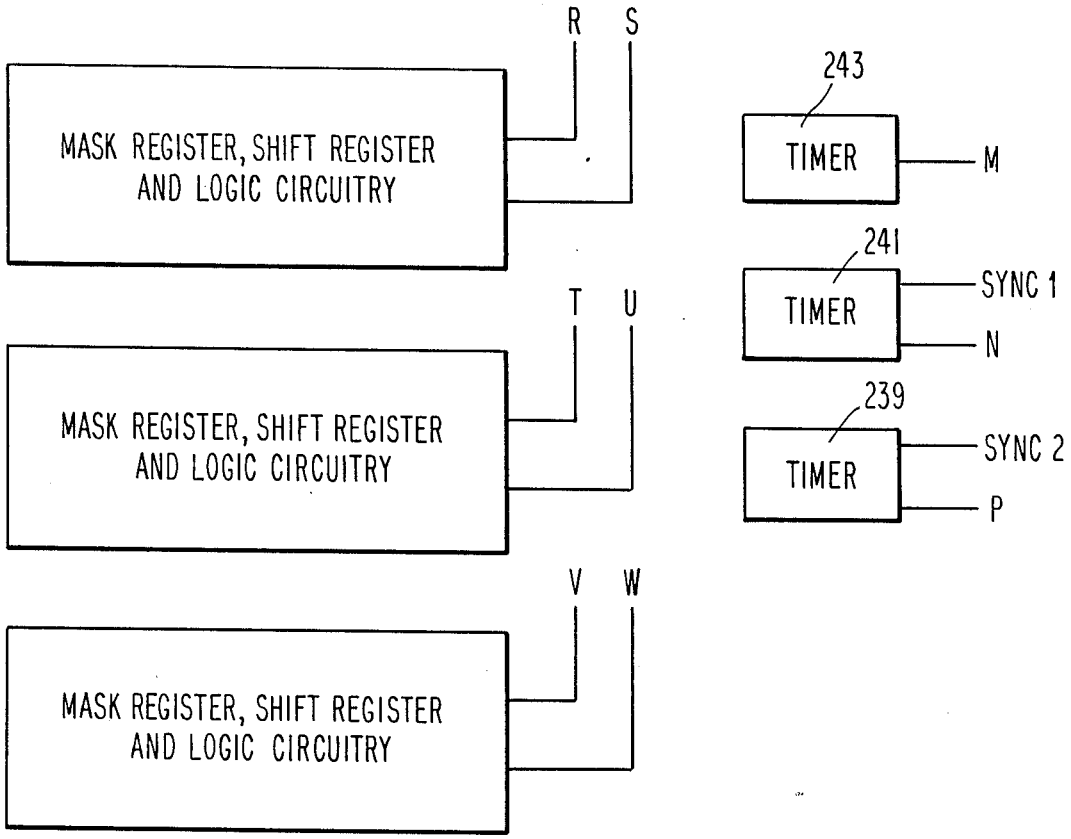
Figure 5:
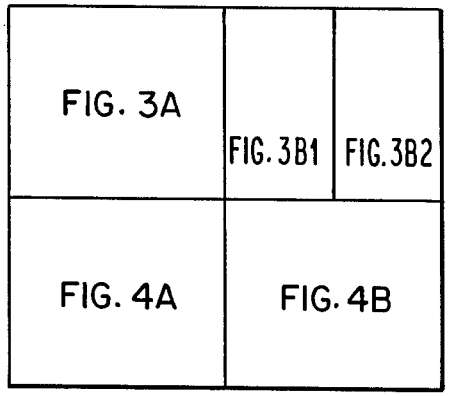
Figure 6:
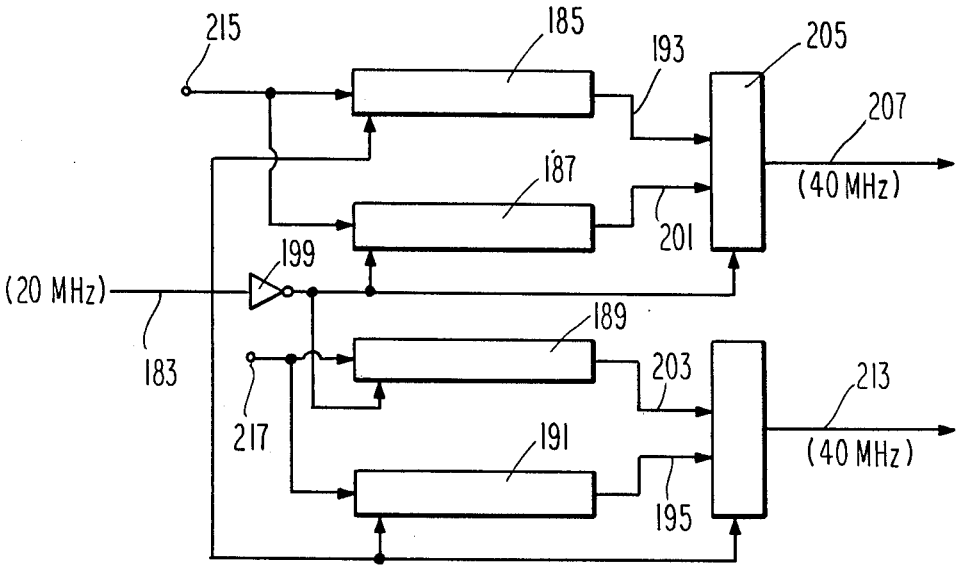
Figure 7:
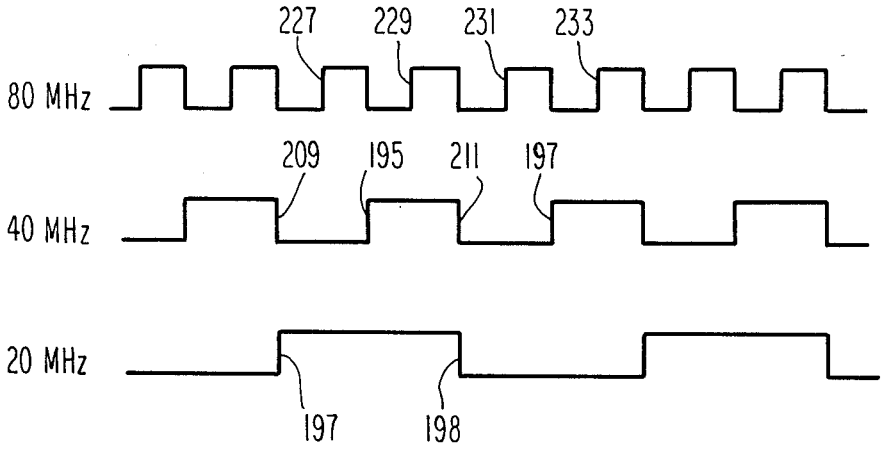
Figure 8:
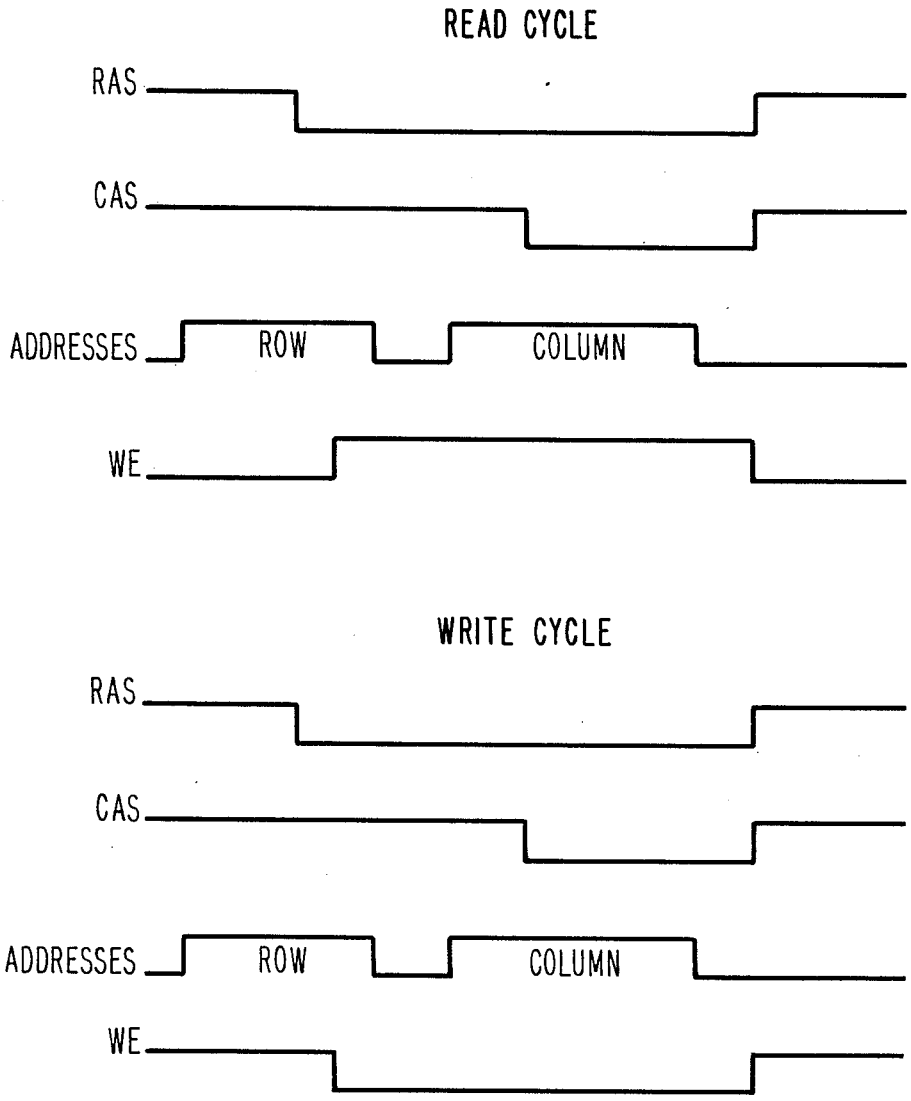
Figure 9:
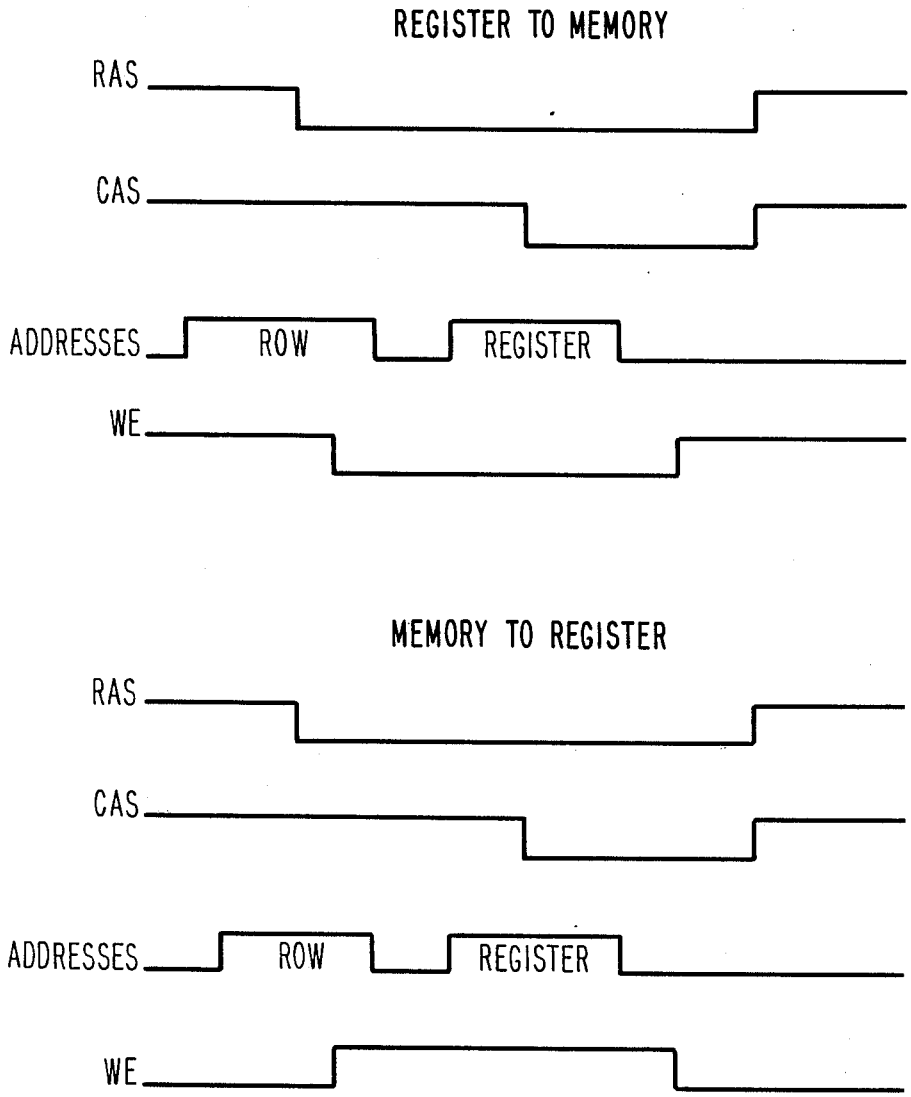
Figure 10:
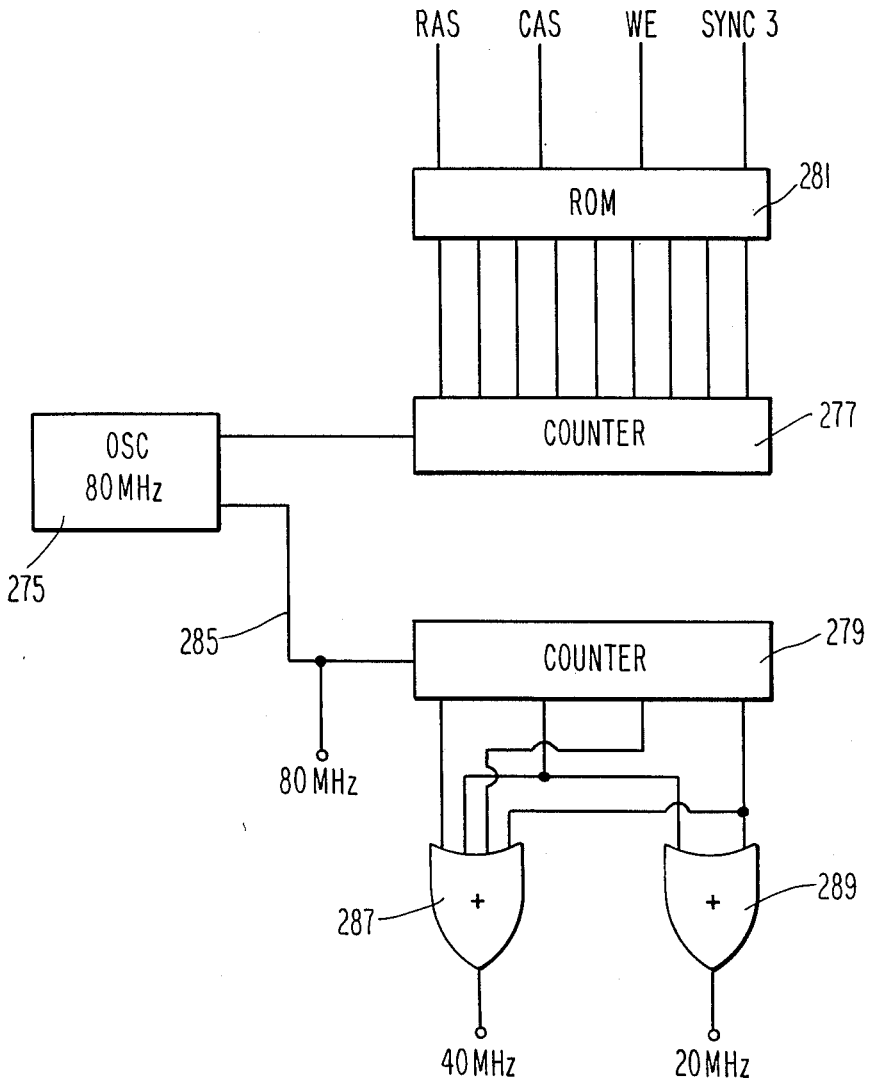

FIGS. 3A, 3B1 and 3B2 depict a block diagram schematic showing four bit map memory units in one plane and the accompanying shift register arrangements therefor;

FIGS. 4A and 4B depict, in far less detail, the arrangement of three other rows of four bit map memory units and the accompanying shift register arrangements associated therewith;

FIG. 5 shows the arrangement of FIGS. 3A, 3B1, 3B2, 4A and 4B;

FIG. 6 depicts the arrangement of a shift register unit used in making up the extended high speed shift register of FIG. 3B;

FIG. 7 shows the relationship between 80 MHZ, 40 MHZ and 20 MHZ clock signals;

FIG. 8 shows the relationship between control signals during a read cycle and a write cycle;

FIG. 9 shows the relationship between control signals during a "register to memory" cycle and a "memory to register" cycle; and FIG. 10 shows circuitry to generate certain clock signals.

It should be understood that the preferred embodiment of the present invention is found in an integrated circuit chip arranement. The technique for producing integrated circuit memory devices, logic devices, active and passive elements and shift registers is well understood in the art of fabricating integrated circuits. Instruction information for fabricating such circuits can be found, for instance, in the text, "Physics And Technology of Semiconductor Devices", by Andrew Grove, published by Wiley Co. as well as in the text "Introduction to VLSI Systems", by Carver Mead and Lynn Conway, published by Addison Wesley Co. The present invention resides in the architecture of the circuitry and not in the fabrication of the integrated circuit chip per se. However since the architecture enables the circuitry to be readily made part of an integrated circuit and enhances the data handling of pixel signals, the use of the present invention as provided in integrated circuit form is a substantial advance in the art.

In the following description, the circuitry and its operation will be described as though the components were hard wired on a circuit board. Indeed the present system could be a hard wired set of components, or a hybrid circuit board, or hybrid circuit boards, and could employ core memories, or transistor logic memories, etc. In FIG. 2, there is depicted the elements which are part of the present system and which are found on an integrated circuit chip. By way of limited explanation of the fabrication of the integrated circuits found, or employed, in the present system, it should be pointed out that in order for 256 lines to be arranged as input-/output channels, to and from a bit map memory unit, it was necessary to extend the digit lines beyond the physical positions of the decoder circuits found on a commercially available chip. The foregoing is accomplished by employing a technique of etching a polysilicone layer whereby the digit lines are extended. Bearing in mind that the description describes the circuitry as though it were hard wired components, consider in FIG. 1.

Figure 1:
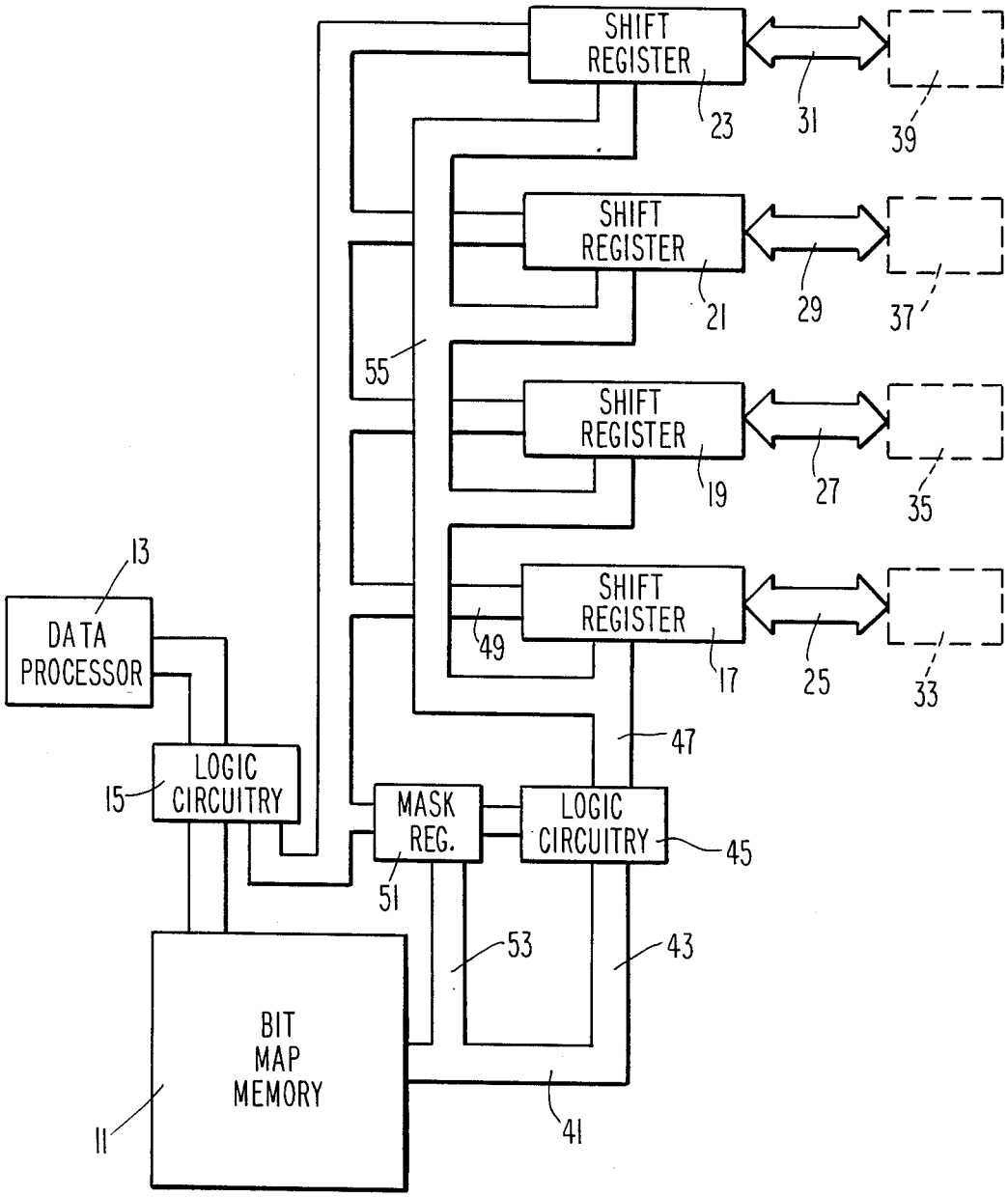
FIG. 1 is a block diagram of the present system.
Figure 2:
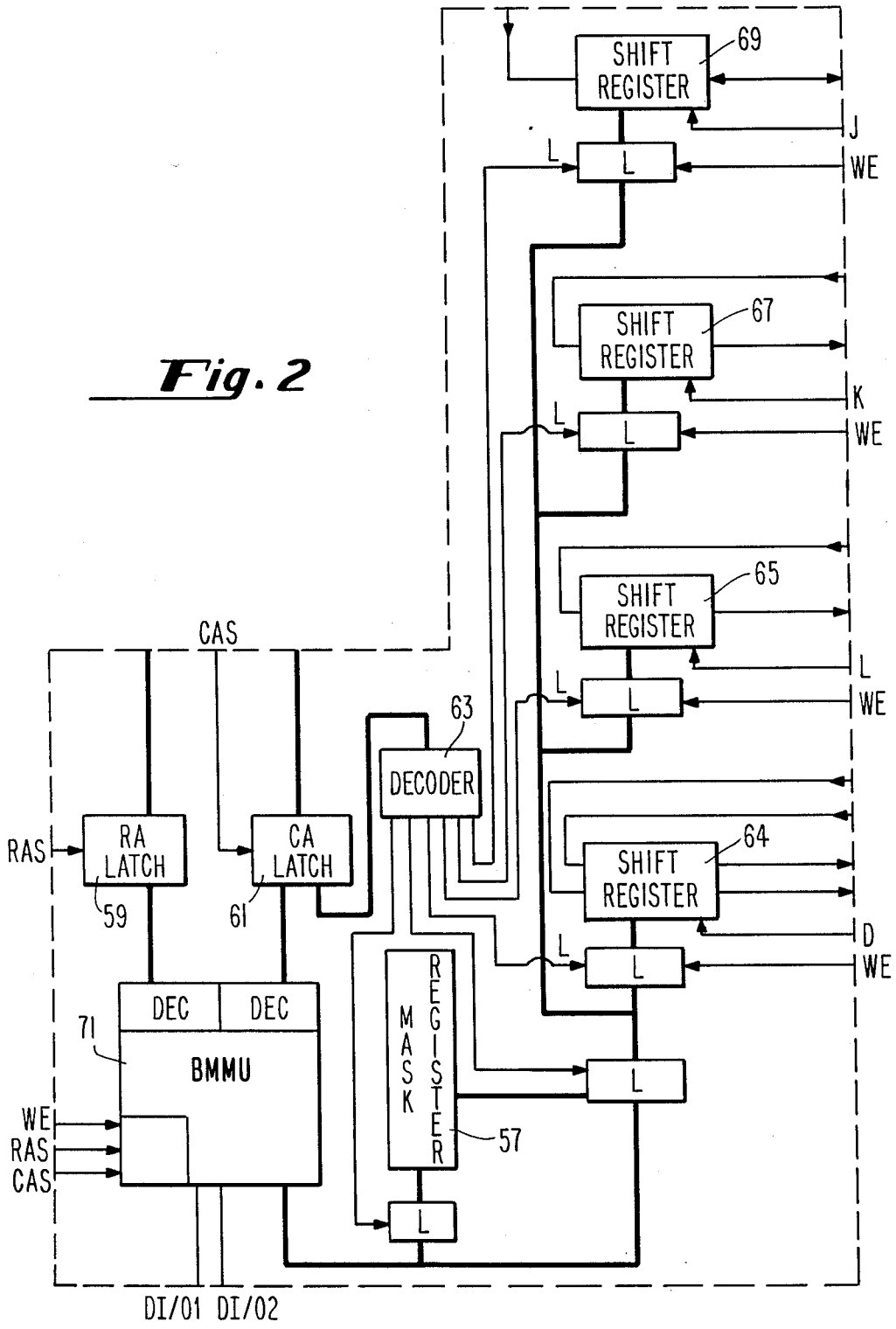
FIG. 2 is a block diagram schematic of the elements found on an integrated circuit chip employed in the present system.

FIG. 1 shows a block diagram of the present system and is described to provide an overview before the description gets into details. In FIG. 1 there is shown a large bit map memory 11. In addition there is shown a data processor 13 and a block of logic and control circuitry 15. Further as can been seen in FIG. 1 there are four extended shift registers 17, 19, 21 and 23. Each of the shift registers 17, 19, 21 and 23 has an input means and an output means as depicted by the double arrowed channels 25, 27, 29 and 31. Connected to the double arrowed channels are dashed lined peripherals 33, 35, 37 and 39. The peripherals are shown in dashed form to indicate that they are not part of the invention.

The overall system operates as follows considering FIG. 1. Information to be shown on a high resolution video display 33, can be transmitted from the data processor, through the logic circuitry 15 into the large bit map memory 11. Said information thereafter can be addressed by the data processor and transferred along channels 41 and 43, through the logic circuitry 45, along channel 47, to the shift register 17. Shift register 17 is conditioned to accept said information by control signals on channel 49. Thereafter the shift register 17 serially transfers said information along channel 25 to the high resolution video display 33.

If the information just described were to represent some window information, i.e. less than a whole screen display, then some of the information bit signals would have been inhibited by logic circuitry 45 and other bit signals would be passed. This partial inhibition is effected by masking information in the mask register 51. Prior to passing the information from the large bit map memory 11 to the shift register 17, the system under the direction of the data processor 13, would transfer masking data from the bit map memory, along channel 41, along channel 53 to the masking register 51. Thereafter, and in response to control signals from the logic circuitry 15, the masking information is transferred to logic circuitry 45 and inhibits certain gates therein the inhibit the flow of certain bit signals therethrough, to effect the window display.

The shift register 19 is arbitrarily assigned to handle pixel information for a slow speed video display 35. Information to be shown on the slow speed video display can be loaded into the shift register 19: from the data processor 13, through the bit map memory 11; from any of the shift registers 17, 21 and 23, by a transfer of said information into and out of the large bit map memory; or, from an outside peripheral connected to its serial input means.

The shift register 21 has been arbitrarily assigned the role of accepting information signals from a slow speed source, such as a disk, camera, tape or the like. If the information received by the shift register 21 were to be displayed on the low speed video it would be transferred to the shift register 19 along a route (composed of channels 55, 47, 43 and 41) into and out of the bit map memory 11, in a fashion similar to that just described. If that information were burdened, as often is the case, with phase distortion, jitter or timing irregularities, such information would be loaded into the shift register 21 and held there momentarily while the irregularities settled down. Thereafter that same information would be transferred in good form as just described, to be seen on the low speed video display 35. If such information were to be seen on the high resolution video display the information would be transferred to the shift register 17.

The shift register 23 has been arbitrarily assigned to handle information which is going to be used in scrolling presentations, or window presentations. The shift register 23 can be activated to shift right or left and hence information bits which needed to be located on new positions in the right or left sense, are manipulated in this shift register. As will be explained in more detail hereinafter, to effect a scrolling operation, information is loaded into the shift register 23 from a certain address in the bit map memory and is returned to the bit map memory at a new address so that the viewer sees the text, or picture, gently moving up (and possibly off) the screen.

FIG. 2 shows the elements which are present on an integrated circuit chip and which are coupled together to make up the system. The identification numbers shown in FIG. 2 are the same as those in FIGS. 3A and 4A and the description thereof is set out in connection with FIGS. 3A and 4A. However, some differences should be noted. In FIG. 2 on the chip there is shown a mask register 57 associated with the shift register units 64, 64, 67 and 69. In the system there actually is one mask register for each chip and hence for each vertically (in the drawings) associated four shift register units. However, in the description of FIGS. 3A and 4A there is only one mask register discussed. Only one mask register is shown to simplify the drawing but philosophically the system operates with the one mask register as it would do with four mask registers. It is likewise true that for each chip there is: an RA latch (such as RA latch 59: a CA latch (such as CA latch 61; and a decoder (such as decoder 63). The description of FIGS. 3A and 4A discusses only one such RA latch 59, CA latch 61 and decoder 63 and philosophically this arrangement would be the same as having four of each. By referring to only one RA latch, one CA latch and one decoder, the drawing is simplified.

Figure 3A:
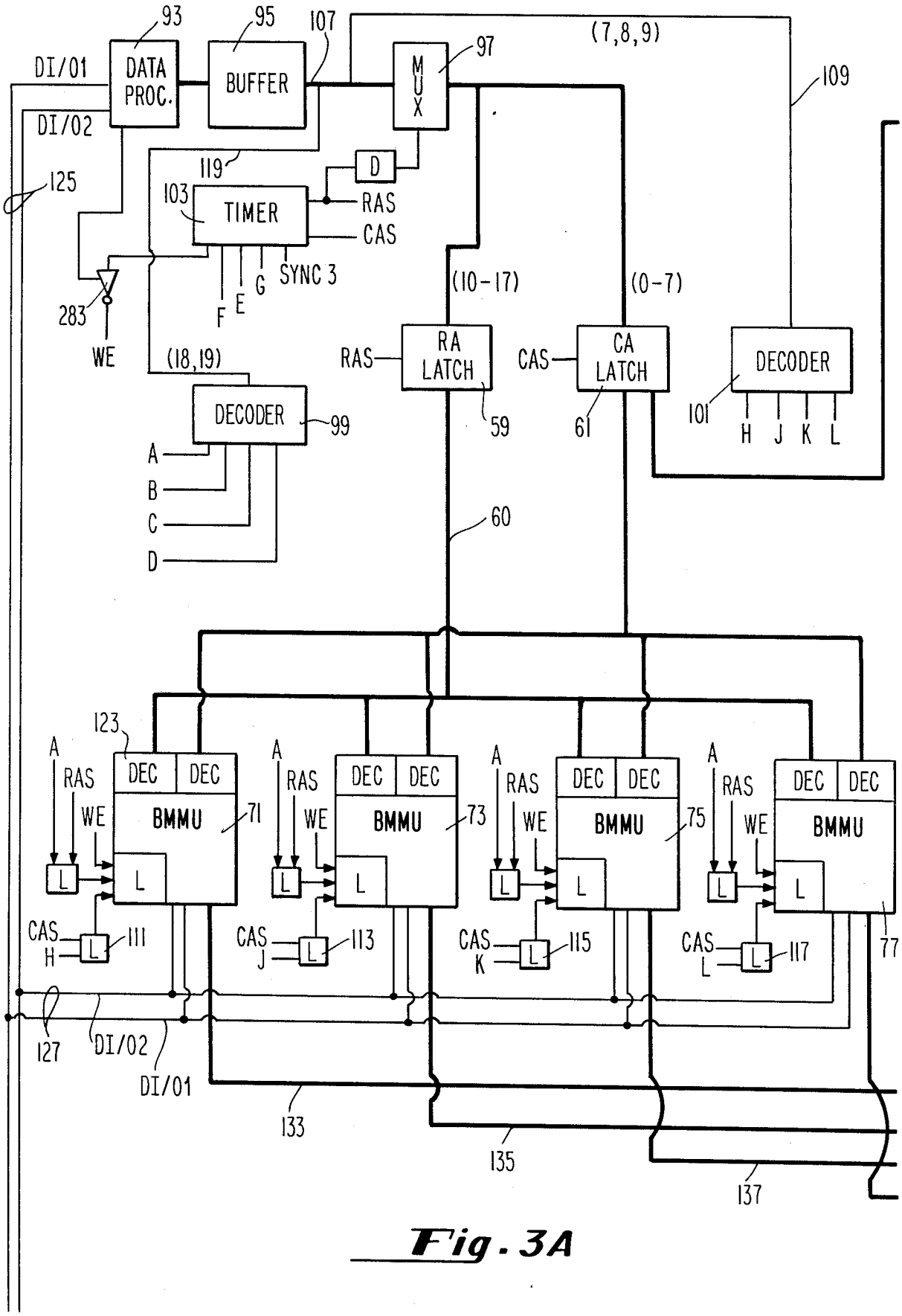

In FIG. 3A wherein there is shown four bit map memory units 71, 73, 75 and 77. The bit map memory units 71, 73, 75 and 77, in the preferred embodiment, are similar to the integrated circuit chips manufactured by Micron Technology Corporation and designated as MT4264 but are altered as described above and as shown in FIG. 2. The bit map memory units used in the present system, such as bit map memory 71, have 256 columns and 256 rows. In the present system there are some sixteen bit map memory units employed as shown. The sixteen bit map memory units can be seen in FIG. 3A and FIG. 4A. In FIG. 4A there are shown the bit map memory units 78 through 89. When the bit map memory units, which are odd numbered 71 through 77 and consecutively numbered 78 through 89, are viewed together and connected together, they represent a large bit map memory having 1024 rows and 1024 columns. Actually, in the preferred embodiment, the system has been designed to accomodate a high resolution display device 91, shown in FIG. 3B, and the high resolution display device 91 has 1024 column positions and 660 row positions. It should be apparent that the large bit map memory formed by the interconnecting of the bit map memory units actually has some positions which are "offscreen". In other words the rows 661 through 1024 contain information, or can contain information, which is not seen on the screen during a display. That information is used to effect operations such as masking, and font character storage.

As can be seen in FIG. 3A, as well as in FIG. 4A, the bit map memory units, such as bit map memory unit 71, each contain two logic means for decoding as well as a logic means to effect read/write (write enable) operations. As depicted in FIG. 3A the righthand most logic circuitry decodes the column addresses, while the lefthand logic circuitry decodes the row address information. The decoding logic circuitry, as well as the write enable logic circuitry, is part of the bit map memory as it is found in the commercially available bit map memory (mentioned above) and no further description of such an operation is deemed necessary. It should be understood that while the embodiment presented herein is related to a high resolution display having 1024 columns and 660 row positions other configurations could be used and still be within the spirit of the present invention. It should also be understood that other bit map memory unit sizes could be employed and yet be within the spirit of the present invention.

To better understand the present system let us consider that there is a data processor 93 which may be any well known data processor having the capability of: being programmable, handling suitable programs, and providing data information, instruction information, and address information. If we assume that the data processor has been programmed to transfer information into the large bit map memory, then the information will be loaded into the bit map memory at some column address and some row address and accordingly the data processor 93 will transmit both column address information signals and row address information signals to the buffer 95. Part of the address information signals will be transmitted from the buffer the 95 to the RA latch 59 through MUX 97, and to the CA latch 61 through the MUX 97. Two bits of the row address are sent directly to the decoder 99 while three bits of the column address are sent to decoder 101. The MUX 97 can be any well known multiplexer such as a 74F157 manufactured by Fairchild Semiconductor Corporation.

Continuing with the above discussion, it should be understood that the multiplexer 97 separates the column address information signals and the row address information signals. The column address signals are transmitted to the column address latch 61, while the row address signals are transmitted to the row address latch 59. The latches 59 and 61 are similar to any one of a number of well known devices such as a 74F374 manufactured by Fairchild Semiconductor Co. As can be gleaned from FIG. 3A, there is a timing signal generator 103 which will be described in more detail in connection with FIG. 10. From the timing generator there is a RAS signal (a row address strobe signal) transmitted to the row address latch 59 as well as a CAS signal (a column address strobe signal) transmitted to the column address latch 61. In a preferred embodiment the address information comprises a 20 bit address on line 107. The first 7 bits (0 through 6) of the address are decodable to provide the column address. The 8th bit (bit 7) being a bit which indicates whether the system is in a random access mode of operation or a register mode of operation (which will be explained hereinafter). Bits 8 and 9 (the 9th and 10th bits) are used to determine which of the bit map memory units, for example which one of the bit map memory units 71, 73, 75 and 77 is going to receive the column address information. The second ten bits of the address information provide bits 10 through 17 to determine the row address within the bit map memory, while the bits 18 and 19 determine which one of the rows of bit map memory units, such as the rows starting respectively with bit map memory units 71, 78, 82 and 86 is to receive the row address information. It should be noted that the reason the system needs only 7 bits to determine the column address while it needs 8 bits to determine the row address information is because (as will become clear hereinafter) the data processor 93 transmits (or reads) two bits for two column positions, at one time, in response to a single column address. To say that another way, if in fact the column address were "zero" there will be transmitted to or selected from, the bit map memory, one bit in column 1 as well as one bit in column 2. If the second column address were "one" there would be a bit transferred to or from in both selected columns 3 and 4. The two column bit pattern continues throughout the column addressing. Hence if there are 1024 column bits to be accomodated, it is only necessary that 512 addresses be available and 512 addresses require only 7 bits.

In view of the above discussion it can be understood that the 20 bit address signals are transmitted on line 107 to the MUX 97. The MUX 97 is controlled by a delayed RAS signal. When the delayed RAS is not present, the bits 10 through 17 are transmitted to both latches 59 and 61. However only latch 59 will be enabled and it will store the bits 10 through 17. It should be understood that latches 59 and 61 only respond to leading edge changes in control signals. When the delayed RAS is present, the bits 0–7 are transmitted to both latches 59 and 61. However only latch 61 will be enabled (by the leading edge of the CAS signal) and it will store bits 0 through 7. The bits 7, 8 and 9 are transmitted on line 109 to the decoder 101. If the bit 7 is high then all of the column lines are activated because bit 7 in its high form indicates a register mode and hence every bit in the row selected by the row address should be transferred from the bit map memory unit. If the bit 7 is low the system is in a random access mode and the column of bit map units selected by decoding bits 8 and 9, receives the column address signals from latch 61. Accordingly the decoder 101 transmits one of four signals, on the lines H, J, K and L. Each of these lines respectively goes to one of the logic gates 111, 113, 115 and 117. Hence one of those gates is fully enabled and passes the CAS signal, which in turn causes the logic within the bit map memory unit to permit the bits 0–6 to select a column address in the correct bit map memory unit.

In a similar fashion the eight bits 10 through 17 which make up the row address are transmitted to the latch 59 as described above. The bits 18 and 19 are separately transmitted on line 119 to the decoder 99. In a fashion similar to that described with the column address signals, the row address signals, are transmitted from the RA latch 59 to the decoders of the respective bit map memories 71, 73, 75 and 77. At the same time such row address information is transmitted to similar logic gates associated with the bit map memory units 78 through 89. The same row address information will be sent to each of the bit map memory units which lie in the same row of bit map memory units. In other words each row of bit map memory units, such as the row made up of bit map memory units 71, 73, 75 and 77, will receive the same row address information. However only the row of bit map memories which receives the enabling signal from the decoder 99 is the row of bit map memory units which will respond to the row address information. It should be remembered that since the system represents a vary large bit map memory (1024 columns) a row of information, that is 256 bits, in the bit map memory unit 71 is insufficient. Accordingly such a row of information is enlarged by adding the 256 bits of each four bit map memories. The large bit map memory includes (collectively) the 256 bits of each of the bit map memory units 71, 73, 75 and 77 to provide 1024 column positions.

The decoder 99 provides enabling signals A, B, C and D and these signals determine which one of the rows of bit map memory units is going to respond to the row address information. For instance the A signal to logic circuit 121 permits the RAS signal to pass to the internal logic which causes the bit map memory unit 71 to respond to the row address signals at decoder 123. The other selections are straight forward from the circuitry set out in FIG. 3A. To summarize thus far we have considered how the large bit map memory is addressed by column address signals and by row address signals.

It can be seen in FIG. 3A that from the data processor 93 there are two lines 125 which are further labeled as DI/01 and DI/02. Those two designations stand for data input/output one and data input/output two. It should be understood that there is a twofold reason that the present system uses a two bit simultaneous input from the data processor. First the data processor is a 16 bit word data processor. Secondly in the preferred embodiment, instead of there being one plane of bit map memory units, (as shown in FIGS. 3A and 4A) there are in fact eight planes, to accomodate variations in picture intensity and to accomodate the need to provide color presentations. Since there are eight planes and there are sixteen bits available in a single transmission of a word, it readily follows that two of the bits are available for each bit map memory plane in the array of eight planes. As stated before, for a single column address two bits can be written or read as directed by the data processor. In FIG. 3A, the DI/01 and DI/02 signals are transmitted over the lines 125, to the lines 127, 129 and 131, and therefrom to each of the bit map memory units 71, 73, 75, 77 and 78 through 89. The information from the two lines 125, going to the bit map memory units, is available to each pair of column lines in each bit map memory. However it is only the column lines that are selected by the column address which actually participate in the read or write operation. This procedure is well understood in the data processing art and no further description of that operation appears to be necessary. Accordingly it should be apparent how information is transmitted from the data processor into the large bit map memory. In the large bit map memory there is a pixel position for every pixel position on the high resolution screen of the higher resolution device 91. The information to paint that display can be read into the bit map memory from the data processor through the DI/01 line and DI/02 line as just described.

As can be further gleaned from FIG. 3A there are channels 133, 135, 137 and 139 respectively connected to the bit map memories 71, 73, 75 and 77. It should be understood that the last mentioned channels, such as channel 133, are made up of 256 lines so that when there is a readout from a bit map memory unit, an entire 256 bits can be read onto the channel 133 and transmitted therefrom to the shift register structure as shown in FIGS. 3B1 and 3B2, as will be described immediately hereinafter. If a readout of a row, (from for instance the bit map memory unit 71), is to be effected, then the row address signals will be transmitted to the bit map memory, in particular to the decoder 123, as described earlier, as well as the column address bit 7, equal to a logic ONE. In addition the write enable signal transmitted to the logic circuitry 141 will be high to effect the readout. In addition the logic 121 will be fully enabled. The 256 bits will be transmitted over channel 133 to the two logic circuit blocks 143 and 145. If the information read from the bit map memory, is "mask information", then the logic circuitry 143 will be enabled, by a signal on line 147, and the 256 bits will be transmitted into the mask register 57. Such mask information will be used to condition a plurality of gates (during the presence of a control signal on line 149) in the logic circuit 145 to enable certain of the signals on channel 133 to be transmitted therethrough and to inhibit the remaining signals. If in fact the only purpose of the readout from the bit map memory unit 71 were to provide "mask information" to the mask register 57, then it will be accomplished as just described. While the same information would be transmitted through the gates 145 and along the channel 151 none of the logic circuits 153, 155, 157 and 159 will be enabled to transmit that information therethrough to the respective shift register units associated with those logic circuits.

If on the other hand, we assume that the readout from the bit map memory 71 were for some other purpose, (by way of example to store information in the shift register unit 64) then the logic circuit 153 would be conditioned by a signal on line 161 to transmit that information therethrough and the 256 bits would be loaded, in parallel, into the shift register unit 64.

Before we continue with the description of the shift registers and their operation, we should consider the generation of the enabling signals from the decoder 63. It will be recalled that there were 8 bit address signals (bits 0–7) transmitted to the column address latch 61. The address signals in column latch 61 serve a multiple purpose. In one mode such signals are column address signals, while in another mode such signals are decoded to determine: which one of the shift registers will receive information; whether or not the mask register 57 receives mask information; whether or not the mask information is to be used at logic circuit 145; and which direction, right, or left, shift register 163 is to be shifted. It will be noted that coming from the decoder 63 there are seven lines 165 and the signals on those lines are generated, in response to decoding the first seven bits, as well as bit 7 (8th bit) of the column address information. The foregoing eight bits, as described earlier, are transmitted to the column address latch 61. If the bit 7 is a ONE, the decoder 63 will provide signals on lines 165, and as explained earlier the bit 7 signal also renders all of the column lines active. When the data processor is effecting a readout from the bit map memory to the shift register, it also takes into consideration where that information is to be transmitted amongst the shift registers. For instance if such information were to be transmitted to the shift register unit 64, then the bits transmitted to the decoder 63 would be decoded to provide a signal on the enable line 161 which would enable the logic circuitry 153 to transmit the 256 bits to the shift register 64. The enabling or control signals on the lines 147, 149, 167, 169, 171 and 173 are generated in a similar fashion to that described for the enabling signal on line 161 and no further discussion thereof is deemed necessary. The decoder 63 is shown as having output lines to each of the logic gates connected to the shift registers units. As mentioned earlier, actually there is a decoder, such as decoder 63, on each integrated circuit chip, as shown in FIG. 2. By showing only one decoder (decoder 63), the drawing is simplified and yet presents a philosophically correct circuit arrangement. The same is true for latches 59 and 61. Each integrated circuit chip, as shown in FIG. 2, has its own RA latch and CA latch.

Consider now the arrangement of the shift register units to make up extended shift registers. The extended shift register made up of the shift register units 64, 175, 177 and 179, is the high speed extended shift register 181. It will be noted that there are two lines from each of these shift register units, coupling one shift register unit with another. For a moment consider FIG. 6, which depicts the makeup of one of the shift register units such as shift register unit 64. In FIG. 6 it can be seen that there is a clock signal at 20 MHZ being transmitted on a line 183. In FIG. 7 there is shown the relationship between the 20 MHZ clock signal, 40 MHZ clock and 80 MHZ clock signals. In FIG. 6 there are shown four shift register subunits, with each one of which has 64 bits of information therein. Together the four shift register subunits act as one shift register unit which is capable of handling 256 bits.

Consider for the moment that there are 64 bits of information in each of the shift register sub units 185, 187, 189 and 191 shown in FIG. 6. Consider that the system is going to effect a readout of those respective shift register subunits and that in fact those shift register subunits operate, or can be clocked out, in response to a 20 MHZ clock signal being transmitted on line 183. In fact the shift register sub units 185, and 191 respond on the positive going edge of a clock signal applied thereto. Accordingly when the 20 MHZ clock signal is applied to line 183, it is transmitted directly to the shift register subunits 185 and 191 to cause those shift registers to shift one bit position at a time, respectively, on the lines 193 and 195. If we examine FIG. 7, we find that the foregoing action took place on the leading edge 197 of the 20 MHZ signal. When the trailing edge 198 comes into being, that trailing edge is inverted at the inverter 199, in FIG. 6, to provide a leading edge signal to the shift register subunits 187 and 189. Hence there results a bit shift respectively on to the lines 201 and 203. A bit signal which appears on line 201 is immediately transmitted through the MUX 205 to the output line 207 at the time that the leading edge 197 is in being. The MUX 205 receives the bit signals present on line 193 at the time that the trailing edge 198 is in existance so that the signals appearing on line 207 are appearing at a 40 MHZ rate. The foregoing can be seen, if we examine FIG. 7 and look at the trailing edges 209 and 211 which represent a 40 MHZ rate. The times of the trailing edges 209 and 211 are the times that the two signals appear on line 207. Accordingly the shift register subunits 185 and 187, although they are clocked out at a 20 mhz rate (in the arrangement shown in FIG. 6) provide an output signal series of signals on line 207 which is at a 40 MHZ rate. In a similar fashion the shift register subunits 189 and 191 are clocked to provide a series of bits on line 213 which is being transmitted at a 40 MHZ rate.

A further examination of FIG. 6 shows a terminal 215 and a terminal 217. The terminal 215 is connected to both of the shift register subunits 185 and 187. Information is transmitted to the terminal 215 and thereafter to the shift register subunits 185 and 187. The information is clocked into those subunits by the 20 MHZ clock signal as just described. In a similar fashion input signals going into the shift register subunits 189 and 191 is transmitted to the terminal 217 and clocked into those shift register subunits as described above. The outputs signals on the lines 207 and 213 are connected to two similar terminals, that is, similar to terminals 215 and 217 in the next adjacent shift register unit. The above described arrangement can be seen in FIG. 3B1 where the shift register unit 64 is shown connected through two lines to the shift register 175. The shift register unit 175 is in turn connected through two lines to the shift register unit 177 and that shift register unit in turn is connected to the shift register unit 179 by two lines. The two lines represent lines that are similar to the lines 207 and 213. Hence signals being transmitted into the shift register subunits are being transmitted at the rate of 40

MHZ, but since they are only clocked at 20 HMZ, alternatively, it means that the stream coming in at 40 MHZ is actually clocked into the reactive sub units at 20 MHZ. The bit signals are clocked out of those sub units, as just described, at 40 MHZ through the respective MUX devices. It should be understood that in FIG. 3A, the shift register units, (by way of example unit 64) include the MUX devices as well as the inverter, in short, all of that which is shown in FIG. 6. In further consideration of the extended high speed shift register, we find that its final output signals on lines 219 and 221 (in FIG. 3B2) are transmitted to an ECL shift register 223. The ECL shift register 223 is a commercial device designated 10141 manufactured by the Fairchild Semiconductor Company, although it should be understood that other logic devices might be used. The ECL shift register 223 operates such that in response to the leading edge of a signal, on the F terminal with E terminal low, the ECL logic will load a bit signal from line 219 onto the output line 225. On the other hand, in response to a leading edge signal on the F terminal, with the E terminal high, a bit signal on line 221 will be shifted onto line 225. Consider further that connected to the F terminal is a 80 MHZ signal and connected to the E terminal is a 40 MHZ signal. If we look at the representation of the 80 MHZ signal and the 40 MHZ signal, in FIG. 7, we find that at the leading edges 227, 229, 231 and 233, the ECL shift register will load bit signals from line 219 as well as from the line 221, via the logic within the block, onto the output line 225. If we further consider that, at the leading edges 227 and 231, the bit signals on line 219 are transferred to line 225, then we find (examining the signal diagrams of FIG. 7), that at the 229 and 233 leading edges, a bit signal from 221 is transferred to line 225. Hence the output on line 225 is an 80 MHZ series of bit signals and this is the kind of signal series that is necessary to accomodate the high resolution display device 91.

As can be gleaned from FIG. 4B, there are three other high speed extended shift registers and they provide the same kind of outputs as were available on line 225, and those outputs are present on the lines S, U, and W. The output signals on those lines, which are at 80 MHZ, are transmitted to the MUX 235 and therefrom to the high resolution display device 91. The MUX 235 is controlled by the output of decoder 237 which is passed to the latch 238. The latch 238 passes the control signals in response to the enable signal on line 161. It will be recalled that the output from decoder 99 selects which of the rows of bit map memory units is to be operative. Hence, the output from decoder 99 selects which of the lines 225, S, U or V is to be selected by the MUX 235. The enable signal 161, as explained above, indicates that the high speed shift register is addressed. Accordingly it becomes apparent that while the extended shift register is actually clocked at a 20 MHZ rate, it has an output at 80 MHZ which output provides bit signals with the kind of density which is necessary to accomodate the high resolution display device 91.

Again let us examine the output signals on channel 133 from the bit map memory 71, by way of example, and understand that the other bit map memories operate in a similar fashion. If the user of the system decides, through the data processor, that the information should be transmitted into the shift register unit 65 (in FIG. 3B1) and then the 256 bits which are transmitted along the channel 151 are transmitted to the logic 155. The logic 155 is enabled by enabling signal 167 (as described before) and hence the 256 bits are parallel loaded into the shift register unit 65. It should be noted that each of the extended shift registers has a different clock input labelled G, P, N or M and those clock signals are at different clock rates depending upon the utility of the extended shift register. The clock signals P, N, and M in a preferred embodiment, are respectively at the rates 22 MHZ, 14 MHZ, and 25 MHZ. The clock signals P, N, and M are generated by the timing circuits 239, 241, and 243 (FIG. 4B). The timing circuits 239, 241, and 243 can be similar to the circuit shown in FIG. 10. Timing circuit 241 generates a sync 1 signal which can be used with an input device connected to terminal 245 (FIG. 3B1). Timing circuit 239 generates a sync 2 signal which is used with the display device 247.

Above we discussed the loading of 256 bits into the shift register unit 65. It can be determined from FIG. 3B1 that the shift register unit 65 provides output signals which are connected on line 249 to the shift register unit 251. The shift register unit 251 is in turn connected serially to the shift register 253 and the shift register 253 (FIG. 3B2) is serially connected to the shift register 255. The extended shift register 257 made up of the shift register units 65, 251, 253 and 255 is in general assigned to the job of providing relatively low speed output information to the data display device 247. The display device 247 is not high resolution and does not demand high speed data input signals thereto. It can be recognized from FIG. 4B that there are similar slow speed shift registers to provide video output signals for low resolution devices. The output from those other low resolution shift registers are found on the lines with terminals R, T, and V and those terminals are connected to the MUX 259. The MUX 259 is controlled by the output of decoder 261 which is passed to latch 262. The latch 262 provides the control signals in response o the enabling signal 167. The control operation is similar to that discussed with respect to the control operation of MUX 235.

It should be apparent that if the same information were to be displayed on the high resolution device as well as on the low resolution device the same information could be parallel transmitted into the high speed extended register 181 as well as into the low speed extended register 257, and such, that information could be seen on both the high resolution device 91 as well as the low resolution device 247.

The next group of shift register units can be seen in FIGS. 3B1 and 3B2 and are identified as shift register units 67, 263, 265, and 267. Those shift registers are serially connected and are advanced in response to the clock signals N. It should be noted that the shift register unit 67 has an input line connected to a terminal 245. The extended shift register 269, made up of the shift register units 67, 263, 265, and 267 has been assigned the job, or purpose, of receiving video input information signals from a video tape recorder, or a disk, or a camera, and making that information available to either the low resolution display device 247 or to the high resolution device 91, or to the data processor 93. It will be recalled that information coming from the above sources has time relationship problems and by loading such information into the extended shift register 269, before transferring it for ultimate use, overcomes those infirmities. It will be recalled that the channels 133 and 151 and the logic circuitry 153, 155, 157, and 159 are bidirectional devices. Hence, input information which is serially loaded from the terminal 245 into each of the shift register units 67, 263, 265, and 267 in a well known manner, can be parallel transferred in and out of the bit map memory to other shift registers. For instance, if the information in the shift register unit 67 were to be transferred to the low resolution device 247, the logic gate 157, would be conditioned and the 256 bits from the shift register unit 67 would be transferred in parallel, through the logic circuit 157, onto the channel 151, through the bidirectional mask gate 145, back to the bit map memory unit 71 and loaded in an address determined by the row address information on line 60. Thereafter on a subsequent cycle, the information would be read from the bit map memory unit 71, along the channel 133, through the bidirectional mask logic 145, along the channel 151, to the gate 155. The gate 155 would be enabled to load the information into the shift register unit 65. Hence the information which was in the shift register unit 67 has been loaded into the shift register unit 65 and can be serially clocked therefrom to the low resolution display device 247. It should be understood that the shift register units and equivalent logic devices in FIG. 3B and 4B operate as described above.

Finally if we consider the shift register units 69, 271, 273, and 275, it should be understood that those shift register units form an extended shift register 163 which has been assigned the job, or purpose, of effecting a scrolling operation. It should be understood that the shift register units of the extended shift register 163 can shift the information held thereby either to the right or left. It should also be understood that the shift registers used in the system are similar to the shift registers 74S299 manufactured by Texas Instruments Corporation. Such shift registers are tri state, bidirectional shift registers, and include an output enable terminal, a load terminal, a clock terminal, and a serial input terminal. Such shift registers can be shifted right or left. It should be understood that when a "memory to register" cycle is in effect the load terminal receives a signal from decoder 63 while the output enable terminal receives a high WE signal. During a "register to memory" cycle the load terminal again receives a signal from decoder 63 while the WE signal to the output enable terminal goes low. In accordance with the design of the shift register 74S299 just mentioned, it should be considered that the logic circuitry shown associated with a shift register is part of the circuit design of such an integrated circuit chip.

In a scrolling operation the viewer sees, for instance, a line of text on the screen of a CRT and that line of text gently moves up and possibly off the screen. Sometimes this is a necessary operation, if in fact the screen does not accomodate a full document which is to be viewed. The way in which the present system accomplishes a scrolling operation is to have the information rows, which are going to the moved up on the screen, read from the present bit map memory locations. That information is transferred along the channels, (by way of example channels 133 and 151), to the shift registers 69, 271, 273, and 275. Obviously in order to effect that transfer the logic gates, such as logic gate 159 must be conditioned to permit the 256 bits to be transferred from the channel 151 to the shift register unit 69. The foregoing would also be true for the shift register units 271, 273, and 275. The next step would be to fetch the information from the extended shift register 163 and return it to the next higher row address in the bit map memory. This procedure would continue for each row of information of the text which is being scrolled. Accordingly the viewer will see on the screen, the text which was at a lower line a moment earlier. In the present system the time required to transfer 256 bits from the bit map memory unit 71 to the shift register unit 69 and back to the bit map memory at a new location is approximately 800 ns. Accordingly a whole page of text can be readily scrolled.

If the system were required by the user, through the data processor, to effect a window scroll, that is a scrolling of a part of a text, or part of a graphic display, then the rows of information involved in that portion of the display, (where in the window scroll is to take effect), would be transmitted from the bit map memory to the extended shift register 163. However prior to transmitting that information to the extended shift register 163, the mask register 57 would be located with a predetermined set of mask bits so that only a portion of the row information, i.e. only the "window", made up of certain bits in certain columns, would pass through the logic circuitry 145. The window bits would be transmitted to the correct shift register units of extended shift register 163. Accordingly when the selected bits (i.e. the window bits), are returned from the extended shift register 163 to the bit map memory unit 71 they are located in a new address to effect scrolling and therefore the viewer would see only the window bits being scrolled. A similar operation would take place if in fact there were to be a split screen presentation. For instance if there were a window on the screen which was to have a different display than was present in the bit map memory, then "new" window information could be transferred (from some location in memory such as from the off screen section) to the extended shift register 163. The new information to be displayed, as the split screen presentation, or window presentation, could be read from the extended shift register 163 back into the same addresses from whence the window information was originally read. It should also be understood that while the extended shift registers have been assigned specific purposes, they can be interchanged in their purpose because in effect they have similar hardware arrangements.

Consider FIG. 8 which depicts the relationship between: the signals RAS (row address strobe); the signal CAS (column address strobe); the Address signals; and the WE signal, for both a read cycle and a write cycle. As can be determined from FIG. 2 and FIG. 3A, each of the bit map memory units has logic circuitry internal thereto and said logic circuitry responds to WE signals, RAS signals and CAS signals. While a number of operations can be accomplished in response to different combinations of those signals, in the present description we shall only be concerned with a read cycle, write cycle, register to memory cycle and memory to register cycle. If a WE signal is high before CAS goes low then the logic circuitry of a bit map memory circuit, (such as logic circuitry 141 of bit map memory 71) will cause the bit map memory unit to read out information. As will be recalled from the earlier description, if at the time of a read cycle the bit 7 of the column address is low then the read out is on the DI/01 and DI02 lines. The relationship of the WE signal to the CAS signal is shown in the upper half of FIG. 8. On the other hand, as can be seen in the lower half of FIG. 8, if WE goes low before CAS goes low then a write cycle is in effect. If the bit 7 of the column address is low the information written into the bit map memory unit comes from the DI/01 and DI/02 lines.

In FIG. 9 the relationship between the signal RAS, signal CAS, address signals "ROW" and "Register", and signal WE is shown to effect a transfer of information from the shift registers to the bit map memory units and from the bit map memory units to the shift registers. According to FIG. 9, if the WE signal goes low before CAS goes low there is a transfer of information from the shift register to the bit map memory. Such an operation would by a write-in to memory. However in a register to memory cycle shown in FIG. 9 the address available is the register address. That is the address signals from the column address latch 61 as decoded by decoder 63. At the time of the register the memory cycle, bit 7 is high which enables the decoder 63 to provide the register address signals (i.e. the enabling signals).

In the lower half of FIG. 9 there is shown the waveform for a memory to register cycle. If WE goes high before CAS goes low then there is a transfer of information out of the bit map memory units (read out) to the registers. The register address is present because bit 7 of the column address is high.

FIG. 10 depicts a timing signal generator to provide the signals RAS, CAS, WE and sync 3, as well as the 80 MHZ, 40 MHZ, and 20 MHZ clock signals. In FIG. 10 there is shown an 80 MHZ crystal oscillator 275, which is transmitting an 80 MHZ signal to counters 277 and 279. There is a plurality of output signals (taps) from the counter 277 which are transmitted to the ROM 281. By virtue of a well understood technique, the ROM 281 decodes the counter position of counter 277 and provides the gate signals RAS, CAS, WE AND Sync 3 as shown in FIGS. 8 and 9. The WE signal is either high or low depending upon the state of the controllable inverter 283 shown in FIG. 3A.

The 80 MHZ signal is tapped from line 285 to provide an 80 MHZ signal to such terminal as terminal F of the ECL shift register 223 (as described earlier). The 80 MHZ signals is transmitted to drive counter 279 to generate the 40 MHZ signal through OR gate 287 and the 20 MHZ signal through OR gate 289. It should be understood that more sophisticated timing signal generators are employed with some embodiments of the present system.

The present system advances the art of providing pixel signals by arranging a plurality of extended shift registers to be used with an enlarged bit map memory and by having the shift registers operate at different speeds. At least one of those shift registers in a preferred embodiment is designed to operate at very high speeds. In accordance with the prior art, the technology does not provide different speed shift registers, (particularly on the same integrated circuit chip), to be used with a common bit map memory. In addition the present system advances the art of providing pixel signals by including a bidirectional mask device which can mask out any selected bits out of 256 bits or as in the present system any bits out of 1024 bits. The present system advances the art of providing pixel signals by interconnecting extended shift registers and a bit map memory so that information can be entered into the system from peripheral devices as well as being read out of memory simultaneously by low resolution and high resolution devices, and can be repeatedly transferred between shift register units and the bit map memory to effect window scrolling presentations and the like.

We claim:

1. An integrated circuit chip for storing pixel information and masking information and outputting signals representing selected portions of said stored pixel information at a serial output port means in response to control signals and address signals received at a parallel input port means, comprising bit map means having an array of row and column positions for storing said masking information and said pixel information thereat, said bit map memory means having a plurality of data ports, first control means connected to said bit map memory means for enabling the input of pixel masking information from predetermined addresses in said bit map memory means in response to said control signals and said address signals, first shift reg ister means for shifting pixel information stored therein, said first shift register means having a plurality of data ports connected in parallel to said plurality of data ports of said bit map memory means by way of first gating means and a serial data port coupled to said serial output port means, a mask register means for storing selected portions of said masking information, said mask register means being connected to said plurality of data of said bit map memory means by way of a second gating means, said first and second gating means being connected to a second control means for controlling the gating of said first and second gating means in response to said control signals, and said mask register means being connected to said first gating means, wherein said second control means outputs a first gate control signals to said second gating means for enabling the transfer of masking information from said bit map memory means to said mask register means and a second gate control signal to said first gating means for enabling the transfer of pixel information from said bit map memory means to said first shift register means, said masking register means transferring said selected portions of said masking information to said first gating means for masking predetermined bits of said selected portions of said pixel information.

2. A circuit arrangement for storing pixel information and outputting signals representing selected portions of said pixel information for display by a display device, comprising first and second integrated circuit chips, said first integrated circuit chip storing pixel information and outputting signals representing selected portions of said stored pixel information at first serial output port means in response to control signals and address signals received at first parallel input port means, said first integrated circuit chip comprising first bit map memory means having an array of row and column positions for storing said pixel information thereat, said first bit map memory means having a plurality of data ports, first control means connected to said first bit map memory for enabling the input and output pixel information to and from predetermined addresses in said first bit map memory means in response to said control signals and said address signals, first shift register means having said first serial output port means and a plurality of data ports connected in parallel to said plurality of data ports of said first bit map memory means by way of first gating means arranged in said first integrated circuit chip for gating the flow of pixel information between said first bit map memory means and said first shift register means, said first gating means being connected to second control means arranged in said first integrated circuit chip for controlling the gating of said first gating means in response to said control signals, and said second integrated circuit chip storing pixel information and outputting signals representing selected portions of said stored pixel information at second serial output port means in response to second control signals and second address signals received at second parallel input port means, said second integrated circuit chip comprising second bit map memory means having an array of row and column positions for storing pixel information thereat, said second bit map memory having a plurality of data ports, third control means connected to said second bit map memory means for enabling the input and output of pixel information to and from predetermined addresses in said second bit map memory means in response to said second control signals and said second address signals, second shift register means having first serial input port means coupled to said first serial output port means, second serial output port means coupled to said display device and a plurality of data ports connected in parallel to said plurality of data ports of said second bit map memory means by way of second gating means arranged in said second integrated circuit chip for gating the flow of pixel information between said second bit map memory means and said second shift register means, said second gating means being connected to fourth control means arranged in said second integrated circuit chip for controlling the gating of said second gating means in response to said second control signals, wherein said second control means outputs a first gate control signal to said first gating means at a first predetermined time for enabling the transfer of first pixel information between said first bit map memory means and said first shift register means and said fourth control means outputs a second gate control signal to said second gating means at said first predetermined time for enabling the transfer of second pixel information between said second bit map memory means and said second shift register means, and said first and second shift register means shift out said first and second pixel information simultaneously after said first predetermined time, said first pixel information being shifted into said second shift register means as said second pixel information is being shifted out of said second shift register means and then being shifted out of said second shift register means, whereby said display device receives said first pixel information for display after receiving said second pixel information.

3. A circuit arrangement for storing pixel information and masking information and outputting signals representing selected portions of said stored pixel information for display, comprising bit map memory means having an array of row and column positions for storing said masking information and said pixel information thereat, said bit map memory means having a plurality of data ports, first control means connected to said bit map memory means for enabling the input of pixel and masking information from predetermined addresses in said bit map memory means, first shift register means for shifting pixel information stored therein, said first shift register means having a plurality of data ports connected in parallel to said plurality of data ports of said bit map memory means by way of first gating means, a mask register means for storing selected portions of said masking information, said mask register means being connected to said plurality of data ports of said bit map memory means by way of a second gating means, said first and second gating means being connected to a second control means for controlling the gating of said first and second gating means, and said mask register means being connected to said first gating means, wherein said second control means outputs a first gate control signal to said second gating means for enabling the transfer of masking information from said bit map memory means to said mask register means and a second gate control signal to said first gating means for enabling the transfer of pixel information from said bit map memory means to said first shift register means, said masking register means transferring said selected portions of said masking information to said first gating means for masking predetermined bits of said selected portions of said pixel information.

4. The circuit arrangement as defined in claim 3, further comprising third gating means connected between said first shift register means and said first gating means, and second shift register means for shifting pixel information stored therein, said second shift register means having a plurality of data ports connected in parallel to said plurality of data ports of said bit map memory means by way of fourth gating means and said first gating means connected in series, wherein said second control means outputs a third gate control signal to said third gating means for enabling the transfer of pixel information to said first shift register means from said first gating means and a fourth gate control signal to said fourth gating means for enabling the transfer of pixel information from said second shift register means to said first gating means.

5. The circuit arrangement as defined in claim 4, further comprising third and fourth shift register means connected to said first gating means by way of fifth and sixth gating means respectively.

6. The circuit arrangement as defined in claim 4, further comprising a first clocking means connected to said first shift register means for supplying clock signals at a first predetermined clocking rate and a second clocking means connected to said second shift register means for supplying clock signals at a second predetermined clocking rate.

7. The circuit arrangement as defined in claim 6 wherein said first shift register means has an output port for supplying pixel information in series to a first peripheral device at a first rate dependent on said first predetermined clocking rate, and said second shift register means has an output port for supplying pixel information in series to a second peripheral device at a second rate dependent on said second predetermined clocking rate.

8. An integrated circuit chip for receiving, storing and outputting pixel information for display, comprising:

parallel input port means for receiving control signals and address signals, serial input port means for receiving serial signals representing bits of said pixel information, bit map memory means having an array of row and column positions for storing said bits of pixel information thereat, said bit map memory means having a plurality of data ports, a plurality of address ports and a plurality of control ports, said address ports and said control ports being coupled to respectively receive address signals and control signals from said parallel input port means, serial output port means for sending serial signals representing selected bits of said stored pixel information in response to control signals and address signals received at said parallel input port means, first gating means coupled to said plurality of data ports of said bit map memory means and coupled to receive control signals from said parallel input port means, second gating means coupled to said plurality of data ports of said bit map memory means and coupled to receive control signals from said parallel input port means, first shift register means coupled to said serial input port means, to said parallel input port means and to said first gating means, said first shift register means having a serial data port coupled to receive bits of pixel information from said serial input port means, having a control port for receiving control signals from said parallel input port means and having a plurality of data ports coupled to send bits of pixel information in parallel to said plurality of data ports of said bit map memory means by way of said first gating means, and second shift register means coupled to said serial output port means, to saod parallel input port means and to said second gating means, said second shift register means having a serial data port coupled to send bits of pixel information to said serial output port means, having a control port for receiving control signals from said parallel input port means and having a plurality of data ports coupled to receive bits of pixel information in parallel from said plurality of data ports of said bit map memory means by way of said second gating means, whereby said bit map memory means receives and stores bits of pixel information serially input on said serial input port means at addresses corresponding to address signals input on said parallel input port means and in response to control signals input on said parallel input port means corresponding to a first mode, and said serial outport port meand outputs bits of pixel information read from addresses in said bit map memory means corresponding to address signals input on said parallel input port means and in response to control signals input on said parallel input port means corresponding to a second mode, and further comprising decoding means, said first and second gating means being respectively coupled to said parallel input port means by way of said decoding means, and masking means coupled to said decoding means and coupled between said bit map memory means and said first and second gating means, said masking means masking bits of pixel information transferred between said bit map memory means and said gating means in dependence on masking information input on said serial input port means and stored in said bit map memory means.

9. The integrated circuit chip as defined in claim 8, wherein said decoding means and said bit map memory means are coupled to said parallel input port means by way of latching means.

* * * * *